United States Patent [19]

Bielagus

[11] Patent Number: 4,836,388

[45] Date of Patent: Jun. 6, 1989

[54] APPARATUS FOR SEPARATING MATERIAL BY LENGTH

[75] Inventor: Joseph Bielagus, Tualatin, Oreg.

[73] Assignee: Beloit Corporation, Beloit, Wis.

[21] Appl. No.: 186,541

[22] Filed: Apr. 27, 1988

[51] Int. Cl.[4] ..... B07C 13/04

[52] U.S. Cl. ..... 209/672; 198/382; 209/667

[58] Field of Search ..... 209/667, 671, 672, 254, 209/617; 198/382

[56] References Cited

U.S. PATENT DOCUMENTS

| | | | |
|---|---|---|---|
| 1,641,777 | 9/1927 | Newhouse | 209/672 |
| 2,124,856 | 7/1938 | Kohler | 209/672 |
| 3,478,861 | 11/1969 | Elmendorf | 198/382 X |
| 4,101,420 | 7/1978 | Luginbühl | 209/672 |
| 4,452,694 | 6/1984 | Christensen et al. | 209/672 |

FOREIGN PATENT DOCUMENTS

| | | | |
|---|---|---|---|
| 924266 | 7/1947 | France | 209/672 |

*Primary Examiner*—Johnny D. Cherry
*Assistant Examiner*—Donald T. Hajec
*Attorney, Agent, or Firm*—Dirk J. Veneman; Raymond W. Campbell

[57] ABSTRACT

An apparatus is disclosed for separating material by length into first and second fractions containing, respectively, material longer than a specified length and material shorter than a specified length. The apparatus includes a plurality of generally parallel shafts having disks attached thereto. The disks are spaced on the shafts a distance approximately equal to one-half the specified length. Shaft diameters and shaft spacings are selected to cause material in the first fraction to remain supported by the shafts and to flow along the shaft surfaces from one shaft to the next adjacent downstream shaft, while material in the second fraction tilts and falls downwardly between adjacent shafts.

15 Claims, 2 Drawing Sheets

APPARATUS FOR SEPARATING MATERIAL BY LENGTH

BACKGROUND OF THE INVENTION

This invention relates to an apparatus for sorting chip-like or wafer-like material by length, and relates particularly to an apparatus suitable for use in sorting jumbo wood chips or wafers by length.

In many wood utilizing processes, it is common to reduce pulp wood logs into chips before further processing. To utilize the chips, it is preferred that from each individual chip to another certain physical characteristics do not vary substantially. In some processes, chip thickness has been perceived as a critical characteristic which should not vary significantly from chip to chip. For example, in the papermaking process, wood chips are cooked in digesters with chemicals at elevated temperatures and pressures to remove lignin and to liberate individual fibers. To prevent underprocessing or overprocessing of individual chips, liquor absorption must be consistent from chip to chip. Thus, it is desirable that all chips be within a specified chip thickness range, to promote consistent processing, and that thinner or thicker chips be processed independently from the main volume of chips falling within the accepted size range.

Various screening and sorting apparatus have been used for sorting chips by chip thickness. Particularly efficient and advantageous processes have been designed including the use of disk screens, in which a plurality of disks are located on a shaft and are positioned adjacent other shafts having disks, with the disks of one shaft interdigitating with the disks of the adjacent shaft. Spacing between adjacent interdigitated disks is uniform. Operation of the screen orients the chips to present the chip thickness dimension to the spaces between interdigitated disks. In this manner, disk screens have been used effectively and efficiently for sorting chips by thickness. In thickness screens, chip length is not measured, and chips of various lengths but similar thickness are processed together.

In other chip utilizing processes, however, it is important to sort the chips by chip length. For example, in manufacturing wafer board, while chip thickness is important, chip length is also a significant physical characteristic. It is often preferred that only chips of a specified minimum chip length be used. Length is particularly important when jumbo wafers are utilized; that is, wafers which may be several inches to one foot in length. Sorting such chips by length has been difficult in the past, and no suitable device for sorting by length in a continuous process has been available. A suitable device for sorting such chips by length must operate to measure the length of the chip, regardless of how the chip is presented to the screening device; and a suitable apparatus must insure that the length dimension used for separation, not the width or thickness dimension. The device should operate to sort a continuous flow of chips efficiently at high volume and with minimal or no plugging.

Shaker screens have been used for screening chips by length with unsatisfactory results, particularly when jumbo wafers are processed. Processing capacities are low, and chips longer then the designed separation length may pass through the screen if the chip is tipped or tilted with respect to the screen openings. Particularly with regard to jumbo wafers wedging in the openings may cause blinding of the screen, further reducing screen capacity and efficiency.

SUMMARY OF THE INVENTION

It is therefore one of the principal objects of the present invention to provide a screening device for separating chip-like material by length, which will orient a chip for lengthwise screening and which minimizes inadvertent screening by width or thickness.

Another object of the present invention is to provide an apparatus for screening wood chips by length, which will accurately screen the length of a chip regardless of the orientation of the chip within the screening plane, and which will process a large volume of chips per screen surface area at high screening efficiency.

Yet another object of the present invention is to provide an apparatus for screening wood chips by length, which can be used to process a continuous flow of chip material, and which is particularly suitable for screening by length jumbo wafers greater than two inches in length.

Still another object of the present invention is to provide an apparatus for screening jumbo wafers, which minimizes blinding or plugging of the screen, and which can be adapted for screening material of various acceptable lengths.

These and other objects are achieved in the present invention by providing a disk-screen-like apparatus in which a plurality of parallel shafts are provided with disks evenly spaced thereon. The space between adjacent disks on a shaft is approximately equal to one half the maximum chip length which will be passed through the screen. Chips longer than two times the disk spacing are passed over the screen. The shafts are positioned with respect to each other such that disks from adjacent shafts are interdigitated, with disk pairs made up from disks of adjacent shafts being minimally spaced from each other. The size of the disks, the diameter of the shafts, and the spacing between shafts are chosen with regard to the maximum length of chip to be passed through the screen. In operation, the disks act to separate by length the chips presented substantially parallel to the shaft axes. The shafts operate to separate chips falling between the disks and presented substantially normal to the shaft axes. Thus, the chips are sorted by length regardless of the angle within the screening plane that the chip is initially presented.

Additional objects and advantages of the present invention will become apparent from the following detailed description and the accompanying drawings.

DETAILED DESCRIPTION OF THE PREFERRED EMBODIMENT

Figure 1:
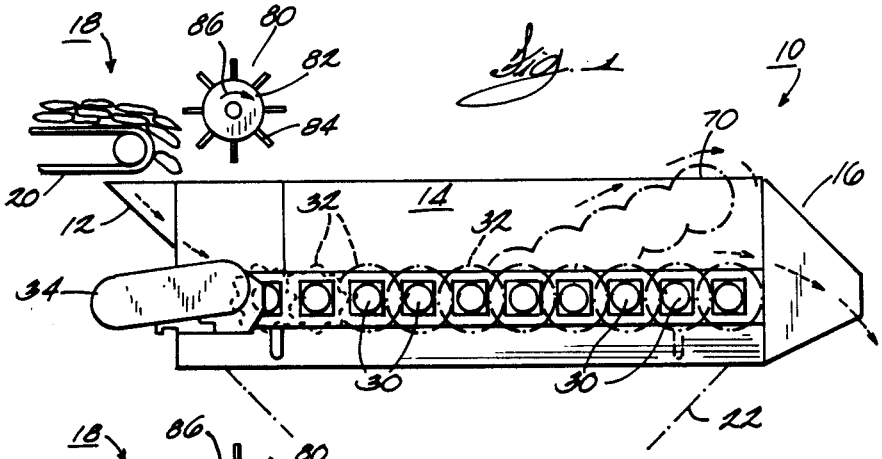
FIG. 1 is a side elevational view of an apparatus for separating material by length embodying the present invention.

Referring now more specifically to the drawings, and to FIG. 1 in particular, numeral 10 designates an apparatus for separating material by length embodying the present invention. While the apparatus of the present invention will be described herein for screening wood chips or wafers, it should be understood that the invention may be used for screening materials other than wood chips.

Apparatus or screen 10 includes an inlet chute 12 for introducing material to be separated onto the apparatus, a screening bed 14 where separation into fractions by length occurs, and an outlet end 16 for collecting and taking away the fraction of material of longer length which passes over the screening bed 14. A continuous flow of wood chips generally indicated by numeral 18, is supplied to the inlet chute of screen 10 by a supply conveyor 20. A collecting means, including a chute 22 and conveying apparatus not shown, is provided for carrying away the fraction of material of shorter length which passes through the screening bed 14.

In some structural aspects, a screen of the present invention is similar to conventional disk screens known and used in the past for thickness screening. For example, the frame, housings, first and second fraction collecting means, and the like are similar to those used on known disk screens, and will not be described further herein.

Screening bed 14 includes a plurality of parallel shafts 30 having disks 32 disposed thereon. The shafts are positioned such that the disks of one shaft interleave with the disks of adjacent shafts. The shafts are driven in a clockwise direction, as shown in FIG. 1, by a suitable drive means 34. The drive means 34 may include means driving outer sleeve assemblies mounted by bearings on stationary shafts, or the shafts may be driven and mounted in bearings on the support frame. Many appropriate drive means are known and currently used for disk screens, many of which will be suitable for the present invention. Through appropriate gearing and the like, it may be advantageous in some applications to drive each shaft slightly faster than the immediately preceding shaft.

Figure 3:
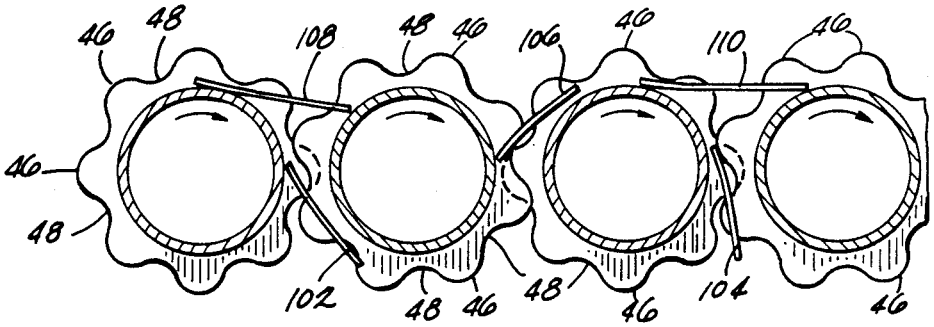
FIG. 3 is an enlarged cross-sectional view of a portion of the screening bed from an apparatus for separating material by length embodying the present invention, illustrating the operation of the shafts in causing separation.

As thus far described, the screening bed 14 is similar to previous screens used for thickness screens. In this regard, as necessary for a more complete understanding of various construction techniques for the shafts and screen bed, the following U.S. patents are incorporated by reference herein: U.S. Pat. No. 4,301,930, "Disk Screen Modular Disk Assembly and Method"; U.S. Pat. 4,538,734, "Disk Screen Apparatus, Disk Assemblies and Method"; U.S. Pat. No. 4,579,652, "Disk Screen Shaft Assemblies and Methods of and Means for Manufacturing the Same"; and U.S. Pat. No. 4,653,648, "Disk Screen or Like Shafts, and Method of Making the Same". As taught by the aforementioned U.S. patents, the disks 32 can be attached to the shafts 30 by any of several means, including, but not limited to welding, mechanical interlocking, compression with resilient spacers, or the like. The shafts may be modular in construction, unitary or may include any of several other shaft constructions. By way of example only, and not limitation, in FIG. 4, the shaft is shown to include a central shaft or rod 36 in an inner sleave 37 having inner end plates 38. The disks are affixed by welding to an outer sleave 40, slightly longer than the inner sleave. Bolts 42 extending through an outer end plate 44 and received in the inner end plate 38 compress the assembly together The present invention differs from heretofore known disk screens for thickness screening in the spacing of and size selection for shafts, the profile and positioning of disks, and in the treatment of the chips by the disks. As shown in FIG. 3, a gently scalloped periphery is provided on each of the disks, with gently rounded peaks 46 and gently rounded valleys 48. For processing particularly large objects, such as jumbo wood chip wafers, the purpose of the disks is for softly agitating the chips without aggressively grabbing or tearing the chips. Previously known chip screens for thickness separation have included disk profiles of an aggressive nature for tumbling and reorienting the chips.

Figure 4:
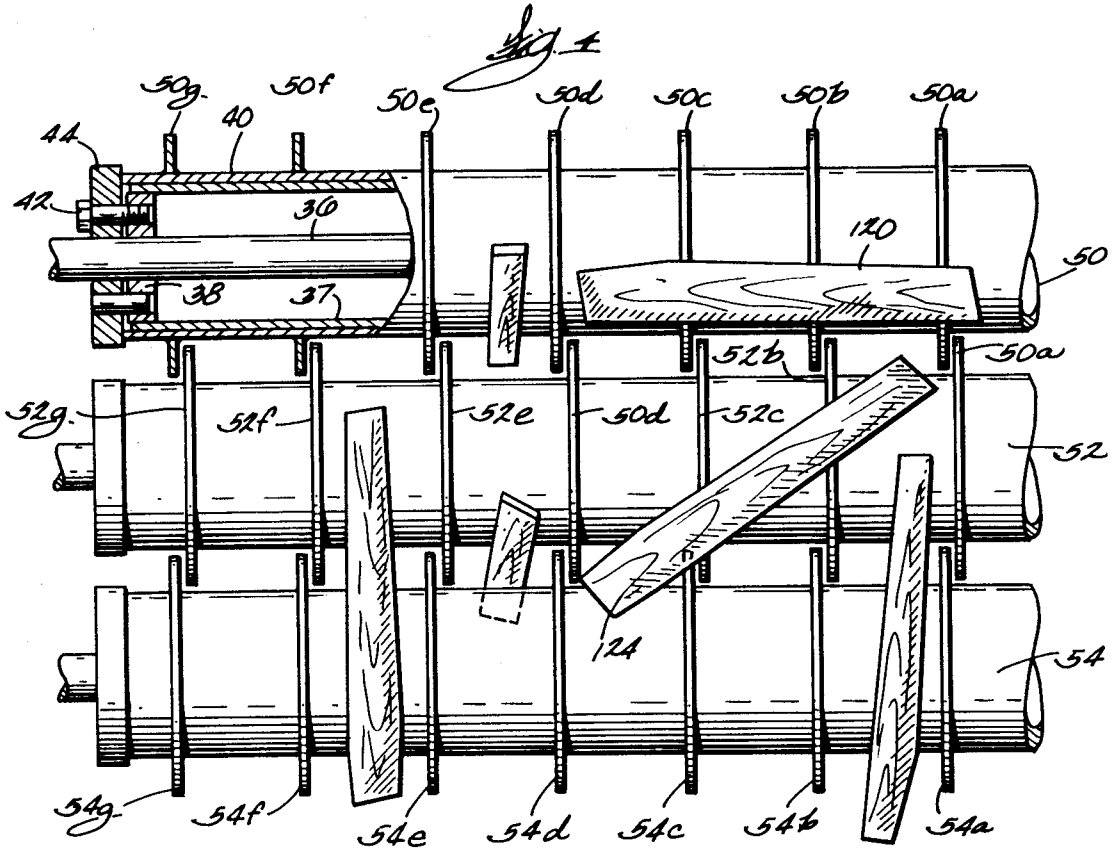
FIG. 4 is an enlarged top plan view, partially broken away, of a portion of the screening bed from an apparatus for separating material by length embodying the present invention, illustrating the operation of the disks in causing separation.

As shown in FIG. 4, the disks on each shaft are evenly spaced on the shaft and are interleaved with the disks of adjacent shafts such that each disk of the first shaft is minimally spaced from a disk of the second shaft, forming a closely-spaced disk pair. The thus formed disk pairs, comprised of a disk from each of two adjacent shafts, are spaced from adjacent similar disk pairs by a distance substantially equal to one-half the length of the longest piece to be passed through the screen or the shortest piece to be passed over the screen.

By way of illustration, FIG. 4 shows shafts 50, 52, and 54. Shaft 50 includes disks 50*a, b, c, d, e, f,* and *g*. Shaft 52 includes disks 52*a, b, c, d, e, f,* and *g*. Shaft 54 includes disks 54*a, b, c, d, e, f,* and *g*. The spacing of disks on a shaft is such that the distance between disks is approximately equal to one-half of the longest chip length to be passed from the top of the screen bed to the bottom of the screen bed between shafts. Thus, for example, if the screen is to separate chips six inches long and longer from chips shorter than six inches, the distance between adjacent disks on a shaft would be approximately three inches. In an assembled screening bed, disks 50*a*, and 54*a* are in substantial alignment, and disk 52*a* is minimally spaced from the disks 50*a* and 54*a*. A substantially greater spacing is provided between disk 52*a* and disks 50*b* and 54*b*. The arrangement is similar for the remaining disks forming pairs and for the remaining pairs thus formed throughout the length of all of the shafts in the screening bed 14.

The diameters of shafts 50, 52, and 54, and the spacing between shafts must be chosen so that chips traveling substantially normal to the shaft axes between the disks are properly separated. Thus, as a chip is carried by one shaft, it must be supported by the surface of that shaft until the leading edge of the chip comes in contact with and is supported by the upward running surface of the next adjacent downstream shaft. By varying the shaft diameters and the shaft-to-shaft spacing, different lengths of material can be separated.

By way of example, a screen was designed for chips ranging in thickness from approximately 50 thousandth of an inch (0.050″) to 100 thousandth of an inch (0.100″), and having a width of approximately two inches. It was desired to separate the chips shorter than six inches in length from those longer than six inches in length. In a test run, separation was performed efficiently with the shafts constructed from a pipe or sleave eight and five-eighths inches ($8\frac{5}{8}$″) in diameter, having disks thereon spaced three inches (3″) on center. The surface-to-surface spacing of adjacent shafts was one and three eighths inch (1⅜").

Figure 2:
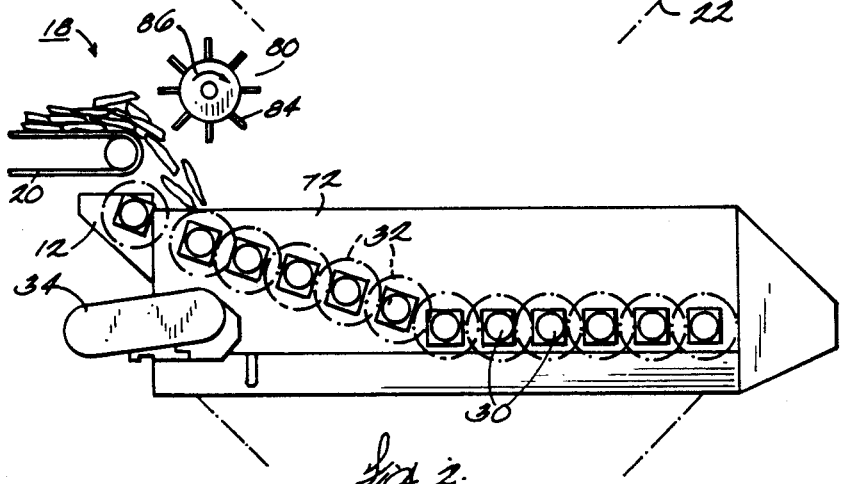
FIG. 2 is a side elevational view of a modified embodiment of the apparatus for separating material by length shown in FIG. 1.

As primarily depicted in FIG. 1, the screening bed 14 is substantially horizontal. It may, however, be advantageous to slant a portion, or all, of the screening bed upwardly or downwardly from the inlet to the outlet end. Thus, in FIG. 1, an elevated outlet end 70 is shown by phantom lines; and, in FIG. 2, an elevated inlet end 72 is shown. While FIGS. 1 and 2 show substantially horizontal sections with the elevated portions, it should be understood that the entire bed may be inclined upwardly or angled downwardly from the inlet end to the outlet end.

In the use and operation of an apparatus for separating material by length embodying the present invention, a substantially continuous flow of wood chips 18 is provided from the conveyor 20 to the inlet chute 12. A raker or evening device 80 may be provided in the inlet chute, for evening the flow of chips onto the screening bed 14. Separating efficiency can be enhanced if the layer of material deposited on the screening bed 14 is essentially one layer thick. In the evening device shown in the drawings, a roll 82 having outwardly projecting fingers 84, is provided and rotates in the direction shown by arrow 86 to provide an even flow of chips onto the screening bed 14.

As the chips are deposited on the screening bed 14, some chips will be oriented with respect to their length, substantially normal to the shaft axes, others will be oriented substantially parallel to the shaft axes, and still others will be oriented at various angles with respect to the shaft axes. As stated previously, the shafts perform the primary separation between the long and short fractions which are oriented substantially normal to the shaft axes. The disks perform the separation between the short fraction and the long fraction of the chips oriented substantially parallel to the shaft axes. The disk profiles tend to gently maneuver the angularly oriented chips into either parallel or normal orientation with respect to the shaft axes for subsequent separation into long and short fractions by the disks or shafts respectively.

The separation performed by the shafts into short and long fractions of the pieces oriented substantially normal to the shaft axes can be most clearly understood with respect to FIG. 3. Short pieces, such as those identified by numerals 102 and 104, may be carried by adjacent material over one or more shafts, but will ultimately ride over one shaft, with the leading edge of the piece tipping downwardly between this shaft and the next adjacent downstream shaft as the piece advances downstream, causing the piece to fall between the shafts. Still other short pieces may be temporarily supported by adjacent material, such that the leading edge will advance onto and forwardly along the next adjacent shaft; however, the trailing end of the chip will tip downwardly, following the downward running surface of the downstream shaft. These chips will also fall downwardly between adjacent shafts. One such chip falling "backwardly" between shafts is shown in FIG. 3, and identified by the numeral 106.

The longer chips oriented substantially normal to the shaft axes will simply ride along the shaft surfaces, progressing from upstream shaft to next adjacent downstream shafts along the screening bed 14. In FIG. 3, a first chip 108 is shown being substantially supported at its upstream end by an upstream shaft, with its leading end making initial contact with the next adjacent downstream shaft. This chip will remain supported by the upstream shaft, with its forward end advancing further downstream as the downstream shaft rotates. Before the rearward end of the chip reaches the point on the upstream shaft where it looses support from the upstream shaft, it is fully supported by the next adjacent downstream shaft, and in such manner will move progressively down the screening bed to the outlet end 16. A chip 110 essentially bridging to adjacent shafts is also shown in FIG. 3.

FIG. 4 illustrates the treatment by the disks of the chips oriented substantially parallel to the shaft axes, and the chips oriented angularly with respect to the shaft axes. As stated previously, the disks on a shaft are spaced apart a distance equal to approximately one-half the length of the shortest chip to be passed over the screen, or the longest chip to fall through the screen. Therefore, chips in the fraction containing the longer lengths will be supported by at least two or more disks of all times when oriented parallel to the shaft axes. One such chip has been identified with the numeral 120, in FIG. 4. The longest unsupported length of such a chip would be substantially the distance between adjacent disk pairs. This portion would be counterbalanced by the portion of the chip supported by the disks, and the chip would continue moving along the screen bed above the disks.

Chips shorter than the predetermined length will be supported by, at most, two disks of a shaft. One such chip is identified by the numeral 122 in FIG. 4. As these chips move along the screen bed 14, as a result of the gentle agitation from the rotating disks, opposite ends of the chip will not advance equally. As one end advances slower or faster than the other end, the chip will be moved to a position in which it is supported only by one disk. This will cause the chip to tip and fall between the shafts, or to fall onto the shafts, and be separated out by the shafts, as described previously.

The chips oriented angularly with respect to the shaft axes, such as the chip identified with numeral 124, will be gently agitated, as described previously, and, if they are of a length in the fraction of longer chips, they will either remain supported by a plurality of disks and carried off the screening bed, or will fall onto the shafts and be carried thereover, as described previously. Shorter chips will be reoriented and separated out, as described above, as well.

Screens of the present invention will process a continuous flow of wood chips or other piece material, and will efficiently separate the material into fragments based on length. By changing the shaft diameter and the shaft surface-to-surface spacing, along with the disk-to-disk spacing on a shaft, the length dimension range in the longer and shorter fractions can be changed.

While one embodiment and several modifications of an apparatus for separating material by length have been shown and described in detail herein, various changes may be made without departing from the scope of the present invention.

I claim:

1. An apparatus for separating a volume of material into first and second fractions, said first fraction including material longer than a specified length, and said second fraction including material shorter than a specified length, said apparatus comprising:

a screening bed for effecting the separation into said first and second fractions;

inlet means for providing a flow of material to be separated on said screening bed;

a first receiving means for receiving said first fraction which passes over said screening bed;

a second receiving means for receiving said second fraction which passes through said screening bed; and said screening bed including;

a plurality of adjacently disposed, substantially parallel shafts;

each of said shafts having a plurality of disks disposed thereon, the spacing between adjacent disks on a shaft being approximately equal to one-half said specified length;

said disks on adjacent shafts being positioned to form pairs of minimally spaced disks including one disk from each of the adjacent shafts;

adjacent pairs of disks being spaced a distance approximately one-half said specified length;

the diameters of said shafts, and the spacing between adjacent shafts being selected to cause material longer than said specified length to ride along the surfaces of said shafts from one to another, as said shafts rotate, while causing material shorter than said specified length to fall between adjacent shafts; and drive means for rotating said shafts as material is fed onto said screening bed.

2. An apparatus for separating material by length, as defined in claim 1, in which said inlet means includes means for evenly distributing material to be deposited on said screening bed.

3. An apparatus for separating material by length, as defined in claim 2, in which said means for evenly distributing material includes a rotatable roll having radially extending fingers.

4. An apparatus for separating material by length, as defined in claim 2, in which said inlet means includes a conveyor and said means for evenly distributing material, operates closely with said conveyor to supply the material to said screening bed in a single layer.

5. An apparatus for separating material by length, as defined in claim 4, in which said means for evenly distributing material includes a rotatable roll having radially extending fingers.

6. An apparatus for separating material by length, as defined in claim 1, in which at least a portion of said screening bed angles downwardly from said inlet to said first receiving means.

7. An apparatus for separating material by length, as defined in claim 6, in which said inlet means includes a conveyor and a rotatable roll having radially extending fingers, with said conveyor and said roll having fingers operating in close proximity for providing a thin layer of material to said screening bed.

8. An apparatus for separating material by length, as defined in claim 1, in which at least a portion of said screening bed angles upwardly from said inlet to said first receiving means.

9. An apparatus for separating material by length, as defined in claim 8, in which said inlet means includes a conveyor and a rotatable roll having radially extending fingers, with said conveyor and said roll having fingers operating in close proximity for providing a thin layer of material to said screening bed.

10. An apparatus for separating material by length, as defined in claim 1, in which at least some of said disks includes a scalloped periphery having gently rounded peaks and gently rounded valleys.

11. An apparatus for separating material by length, as defined in claim 10, in which said inlet means includes a conveyor and a rotatable roll having radially extending fingers, with said conveyor and said roll having fingers operating in close proximity for providing a thin layer of material to said screening bed.

12. An apparatus for separating material by length, as defined in claim 1, in which at least some of said downstream shafts rotate faster than at least some of said upstream shafts.

13. In a disk screen apparatus having a plurality of rotatable, parallel shafts having disks thereon, with disks of adjacent shafts being interleaved, an improvement for adapting the screen for sorting material by length into a first fraction longer than a predetermined length and a second fraction shorter than a predetermined length, said improvement comprising:

said disks being spaced on the shafts a distance approximately equal to one-half said predetermined length;

disks of adjacent shafts being positioned to form pairs containing a disk from each of the adjacent shafts, the disks of said pairs being minimally spaced from each other;

adjacent pairs of disks being spaced a distance approximately equal to one-half said predetermined length; and said shafts having diameters and being spaced from adjacent shafts in an interrelated manner for causing pieces longer than said predetermined length to be continuously supported and carried from shaft to shaft, while causing pieces shorter than said predetermined length to fall between said shafts.

14. The improvement in a disk screen apparatus, as defined in claim 13, in which said disks have scalloped peripheries having gently-rounded peaks and gently-rounded valleys.

15. The improvement in a disk screen apparatus, as defined in claim 13, in which an inlet leveling means is provided for said screen, for depositing the material to be sorted by length substantially in a single layer.

* * * * *